US011623252B2

(12) United States Patent
Prakash et al.

(10) Patent No.: US 11,623,252 B2
(45) Date of Patent: Apr. 11, 2023

(54) SYSTEMS INCLUDING AND METHODS OF USE OF ULTRASONIC DEVICES

(71) Applicant: THE BOEING COMPANY, Chicago, IL (US)

(72) Inventors: Om Prakash, Bangalore (IN); Megha Sahu, Bangalore (IN); Kamaraj Kandhasamy, Bangalore (IN); Sandeep Tripathi, Kanpur (IN); Carolyn L. Kupper, Summerville, SC (US); Stephen P. Gaydos, St. Louis, MO (US)

(73) Assignee: THE BOEING COMPANY, Arlington, VA (US)

( * ) Notice: Subject to any disclaimer, the term of this patent is extended or adjusted under 35 U.S.C. 154(b) by 98 days.

(21) Appl. No.: 17/193,139

(22) Filed: Mar. 5, 2021

(65) Prior Publication Data

US 2022/0280984 A1 Sep. 8, 2022

(51) Int. Cl.
*B08B 3/12* (2006.01)
*B06B 1/02* (2006.01)

(52) U.S. Cl.
CPC ..... *B08B 3/123* (2013.01); *B06B 1/0207* (2013.01)

(58) Field of Classification Search
None
See application file for complete search history.

(56) References Cited

U.S. PATENT DOCUMENTS 5,289,838 A 3/1994 Odell
5,529,635 A 6/1996 Odell
8,448,655 B2 5/2013 Suzuki et al.
10,486,206 B2 11/2019 Carson
2016/0318306 A1* 11/2016 Matsuduki ..... B41J 2/16552
2019/0053782 A1 2/2019 Stigall et al.
2019/0337023 A1* 11/2019 Kirmuss ..... B08B 11/02

FOREIGN PATENT DOCUMENTS

CN 105945003 A 9/2016
CN 106513376 A 3/2017
CN 106824909 A 6/2017
CN 110788070 A 2/2020
EP 1197177 A2 4/2002
EP 3597319 A1 1/2020
KR 2015127696 11/2015

OTHER PUBLICATIONS

European Patent Office, Extended European Search Report for Application 22159144.9-1017 dated Oct. 13, 2022, 10 pages.

* cited by examiner

*Primary Examiner* — Eric W Golightly
(74) *Attorney, Agent, or Firm* — Patterson + Sheridan, LLP

(57) ABSTRACT

A method of using an ultrasonic system includes positioning at least one component to a ultrasonic system, the ultrasonic system including: an ultrasonic device, comprising a plurality of ultrasonic transducers coupled to a flexible body; a power supply coupled to the ultrasonic device; a fluid vessel configured to supply fluid to the at least one component; and a waste vessel configured to collect the fluid supplied to the ultrasonic device from the fluid vessel. The method includes applying, via the power supply, a current to a plurality of ultrasonic transducers to dislodge a plurality of contaminants from the at least one component. The method includes flushing, via fluid from the fluid vessel, the plurality of contaminants dislodged from the at least one component.

25 Claims, 8 Drawing Sheets

SYSTEMS INCLUDING AND METHODS OF USE OF ULTRASONIC DEVICES

FIELD

Aspects of the present disclosure relate to industrial equipment, including inside passages of industrial equipment, as well as inside passages of parts and assemblies that may be fabricated using industrial equipment.

BACKGROUND

Various types of industrial equipment can be employed to fabricate and assemble parts across multiple industries. This industrial equipment can include engineering components having one or more inside passages. Similarly, the parts fabricated by this industrial equipment or fabricated in other ways can also include one or more inside passages. The inside passages of various components, as well as parts fabricated and assembled using industrial equipment, can accumulate buildup of contaminants in their inside passages. The buildup in these inside passages can be challenging to remove given where the buildup is located. Further, the cleaning methods used to remove the buildup can leave behind residue that can be hazardous to the future use of both the industrial equipment and various components. Thus, there remains a need for an improved method of cleaning inside passages.

SUMMARY

The present disclosure provides an ultrasonic system, the ultrasonic system including an ultrasonic device having a flexible body and a plurality of ultrasonic transducers coupled to the flexible body.

In one aspect, in combination with any example ultrasonic system above or below, the ultrasonic system includes a power supply coupled to the ultrasonic device and configured to apply a current to the plurality of ultrasonic transducers; a fluid vessel coupled to the ultrasonic device; and a waste vessel removably coupled to the ultrasonic device.

In one aspect, in combination with any example ultrasonic system above or below, the ultrasonic system includes that the flexible body has a first end, a second end, an outside surface, and an inside surface defining a hollow passage extending from the first end to the second end.

In one aspect, in combination with any example ultrasonic system above or below, the ultrasonic system includes a heating element positioned through the hollow passage of the flexible body.

In one aspect, in combination with any example ultrasonic system above or below, the ultrasonic system includes a plurality of heating elements coupled to the inside surface or the outside surface of the flexible body.

In one aspect, in combination with any example ultrasonic system above or below, the ultrasonic system includes that the fluid vessel is configured to supply a plurality of fluid to the outside surface of the flexible body when the ultrasonic device is positioned through a hollow passage of one or more components.

In one aspect, in combination with any example ultrasonic system above or below, the ultrasonic system includes that the fluid vessel is configured as a process tank and includes a support structure configured to removably couple to the ultrasonic device to the fluid vessel.

In one aspect, in combination with any example ultrasonic system above or below, the ultrasonic system includes at least one positioning element coupled to or embedded in the flexible body, wherein the at least one positioning element is configured to maintain a position of the flexible body relative to a component to be processed by the ultrasonic system.

In one aspect, in combination with any example ultrasonic system above or below, the ultrasonic system includes that the ultrasonic device is configured to be removably coupled to an outside surface a component and to be simultaneously positioned in an inside passage of the component, the fluid vessel being configured to direct a first plurality of fluid towards the outside surface of the component to remove a first plurality of contaminants from the outside surface of the component and to supply a second plurality of fluid to the outside surface of the flexible body to remove a second plurality of contaminants from the inside passage of the component.

In one aspect, in combination with any example ultrasonic system above or below, the fluid vessel being further configured to supply fluid to the first end of the component.

The present disclosure provides an ultrasonic system, the ultrasonic system including an ultrasonic device having a flexible body configured to be removably coupled to one or more components, the flexible body having a first end and a second end; and a plurality of ultrasonic transducers coupled to the flexible body; a power supply coupled to the ultrasonic device (and configured to apply a current to the plurality of ultrasonic transducers to remove contaminants from the one or more components; a fluid vessel configured to supply fluid to the component to flush the contaminants removed from the one or more components; and a waste vessel configured to collect the fluid supplied to the ultrasonic device from the fluid vessel.

In one aspect, in combination with any example ultrasonic system above or below, the ultrasonic system includes that the fluid vessel is configured to direct a plurality of fluid to an outside surface of the one or more components when the ultrasonic device is removably coupled to the outside surface of one or more components.

In one aspect, in combination with any example ultrasonic system above or below, the ultrasonic system includes a support structure configured to couple to the ultrasonic device to position the ultrasonic device in a predetermined configuration relative to a component removably coupled thereto.

In one aspect, in combination with any example ultrasonic system above or below, the ultrasonic system includes that the support structure is configured to position the plurality of ultrasonic transducers from about 0.5 inches to about 6 inches from one or more surfaces of each of the one or more components.

The present disclosure provides a method of using an ultrasonic system, the method including: positioning at least one component to an ultrasonic system, the ultrasonic system having an ultrasonic device which includes a plurality of ultrasonic transducers coupled to a flexible body. The ultrasonic system further includes a power supply coupled to the ultrasonic device; a fluid vessel configured to supply fluid to the at least one component; and a waste vessel configured to collect the fluid supplied to the ultrasonic device from the fluid vessel; applying, via the power supply, a current to a plurality of ultrasonic transducers to dislodge a plurality of contaminants from the at least one component; and flushing, via fluid from the fluid vessel, the plurality of contaminants dislodged from the at least one component.

In one aspect, in combination with any example method of using an ultrasonic system, the method includes: removing, via the waste vessel, the plurality of contaminants and the fluid used to dislodge the plurality of contaminants.

In one aspect, in combination with any example method of using an ultrasonic system, the method includes: filtering, via a filtering system coupled to the ultrasonic system, the fluid used to dislodge the plurality of contaminants to separate the plurality of contaminants from the fluid; depositing, in the waste vessel, the plurality of contaminants separated during the filtering; and returning filtered fluid to the ultrasonic system.

In one aspect, in combination with any example method of using an ultrasonic system, the method includes removably coupling the at least one component to the ultrasonic system by positioning an ultrasonic device inside of the at least one component.

In one aspect, in combination with any example method of using an ultrasonic system, the method includes removably coupling the at least one component to the ultrasonic system by removably coupling an ultrasonic device to an outside surface of the at least one component.

In one aspect, in combination with any example method of using an ultrasonic system, the method includes that removably coupling the at least one component to the ultrasonic system comprises positioning the ultrasonic device inside of the at least one component and removably coupling the ultrasonic device to an outside surface of the at least one component.

In one aspect, in combination with any example method of using an ultrasonic system, the method includes that the power supply is configured to supply a current of 5 amperes (A) to about 15 A to the plurality of ultrasonic transducers.

In one aspect, in combination with any example method of using an ultrasonic system, the method includes establishing a temperature of the ultrasonic device from about room temperature to about 80° C. via at least one heating element embedded in the flexible body.

In one aspect, in combination with any example method of using an ultrasonic system, the method includes applying the current by pulsing the power supply for a plurality of pulses.

In one aspect, in combination with any example method of using an ultrasonic system, the method includes that each pulse of the plurality of pulses is from about 1 second to about 20 minutes.

The present disclosure provides a method of using an ultrasonic system, the method including: removably coupling at least one processing vessel to an ultrasonic system, the ultrasonic system having an ultrasonic device including a plurality of ultrasonic transducers coupled to the flexible body; a power supply coupled to the ultrasonic device; and a plurality of logic stored on a non-transitory computer-readable medium and configured to execute a plurality of programs. The method further including at least one program being configured to apply, via the power supply, an ultrasonic current to the plurality of ultrasonic transducers for a predetermined period of time, each program being associated with at least one processing operation.

In one aspect, in combination with any example method of using an ultrasonic system, the method includes that the at least one processing operation forms a chemically homogenous mixture of two or more constituents.

BRIEF DESCRIPTION OF THE DRAWINGS

So that the manner in which the above recited features can be understood in detail, a more particular description, briefly summarized above, may be had by reference to example aspects, some of which are illustrated in the appended drawings.

DETAILED DESCRIPTION

Figure 1A:
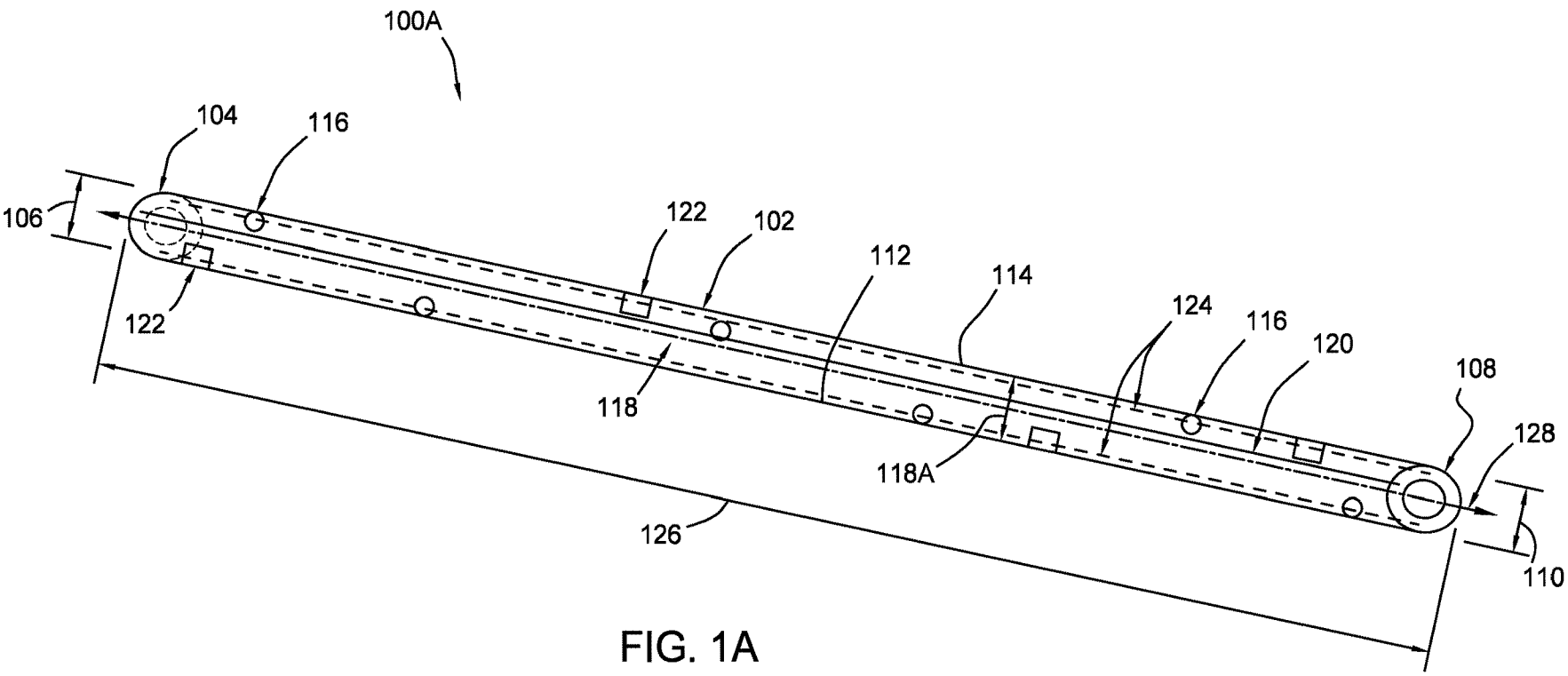
FIG. 1A depicts a first ultrasonic device according to aspects of the present disclosure.

The present disclosure relates to systems and methods of performing various operations using ultrasonic devices, including cleaning operations with or without the use of solvent (liquid). The components discussed herein may be cleaned with reduced amounts of solvent (liquid) as compared to currently employed systems and methods, or may use gas. The term "fluid" as used herein may encompass liquid, gas, combinations thereof, and, in some aspects, may further include particles disposed in the liquid, gas, or combination thereof. The components discussed herein can be used in various types of industrial equipment or on parts and assemblies (referred to collectively as "components" herein) fabricated using the industrial equipment, or which are fabricated using other methods and equipment. The components may include one or more inside passages that may be open on one or both ends of the passage. As discussed herein, "industrial equipment" can be various types of machinery used to make, assemble, clean, inspect, and otherwise fabricate components, for example, aerospace components. The components can include mechanical components, electrical components, or electro-mechanical components. Components such as tubes, hoses, conduits, joints, and other connectors and channels, can each include one or more inside passages, corners, kinks, pinholes, voids, depressions, or other features that may collect debris. The inside passages of the components can accumulate a buildup of contaminants that can be challenging to remove. The contaminants discussed herein can be solids, liquids, or colloids, and can include various process agents used on the industrial equipment, such as degreasers or other solvents, as well as dirt, dust, animal life (e.g., insects), plant life, metal chips resulting from machining, or other foreign-object-debris (FOD) or undesired elements that may negatively impact a component's function, or the function of industrial equipment or other systems (e.g., aircraft bodies or engines) in which it is installed, via clogging or contamination.

Inside passages (which may alternatively be referred to as internal passages) of components can have small, thin, or narrow cross-sections; varying cross-sectional sizes and geometries; twisting, kinked, wound, or other unique geometries and/or corners. Some cleaning methods can be quite both tedious and time consuming due to the combination of contaminant build-up and geometry of the inside passages.

Further, some cleaning methods can leave behind contaminants that are not removed, and can additionally leave behind cleaning media used as a part of the cleaning process. The remaining contaminants and/or cleaning media may cause problems in the function of the component, up to and including causing equipment breakdowns or creating fire hazards.

Accordingly, the systems and methods discussed herein can be used to clean components having one or more inside passages of varying cross-sectional shape and geometries without leaving behind residue, or to perform processing operations such as the formation of homogenous mixtures. When used for cleaning, the methods and systems herein that include one or more ultrasonic devices may be used to clean inside passages having smooth surfaces, rough surfaces, porous surfaces, or surfaces otherwise including features that may retain contaminants or otherwise present a cleaning challenge. In addition, the cleaning methods and systems discussed herein may be used to remove contaminants from outside surfaces of components, in addition to or alternatively to the inside surfaces. Outside surfaces of components may also include grooves, pockets, corners, textures, or other features that may retain contaminants or otherwise present a cleaning challenge. In some examples, two more components may be cleaned simultaneously using one or more ultrasonic devices. The use of ultrasonic devices can create agitation of fluid (liquid or gas, or combinations thereof), including creating a stirring or circular motion of fluid, around and/or through a component, while simultaneously causing vibration of the component to further dislodge contaminants from the component. In other examples, the ultrasonic devices used herein may be used in the absence of liquid, wherein the fluid used to remove contaminants may comprise a gas or gas mixture, resulting in a solvent-free cleaning process. In addition, the systems and methods used herein may have a reduced environmental impact not only due to the type and volume of solvent used for cleaning, but also due to the reduced energy used to operate the systems while still achieving a desired level of cleanliness of the components.

Example Ultrasonic Devices

FIG. 1A depicts a first ultrasonic device 100A according to aspects of the present disclosure. The first ultrasonic device 100A includes a flexible body 102 and a plurality of ultrasonic transducers 116 permanently or removably coupled to the flexible body 102. The flexible body 102 has a first end 104 having a first outside diameter 106 and a second end 108 opposite the first end 104, the second end 108 having a second outside diameter 110. In one example, the first outside diameter 106 is the same as the second outside diameter 110. In another example, the first outside diameter 106 is larger than the second outside diameter 110. In still other examples, the first outside diameter 106 is smaller than the second outside diameter 110. In one example, the first outside diameter 106 and the second outside diameter 110 may differ in measurement by from about 5% to about 90%. In another example, the first outside diameter 106 and the second outside diameter 110 may differ by from about 20% to about 75%. In still another example, the first outside diameter 106 and the second outside diameter 110 may differ by from about 35% to about 50%. The first ultrasonic device 100A may include these different outside diameters, for example, when the first ultrasonic device 100A is to be positioned inside a component with a tapered inside diameter, or when the first ultrasonic device 100A is to be positioned inside two or more components concurrently, each component having a different and/or a tapered inner diameter. As used herein, "about" can mean that a stated target measurement, minimum measurement, or maximum measurement is within +/−5% of that stated measurement In one example, the flexible body 102 is a solid body that does not include an inner passage. In another example, the flexible body 102 is defined by an outside surface 114 and an inside surface 112 defining a hollow passage 118 (which may alternatively be referred to as an "inside passage") along a central axis 128 of the flexible body 102. In one example, an inside diameter 118A of the hollow passage 118 is consisted from the first end 104 to the second end 108. In other examples, the inside diameter 118A may have an increasing or a decreasing diameter (taper) from the first end 104 to the second end 108 of the flexible body 102. The dimensions and relative dimensions of the flexible body 102 can be selected based on factors including the type of material(s) from which the flexible body 102 is formed, the functions performed by an ultrasonic system in which the first ultrasonic device 100A is included, the geometries or dimensions of a component coupled to the an ultrasonic system in which the first ultrasonic device 100A is included, or other factors or combinations of factors. The flexible body 102 can be formed from materials of varying rigidity, including polymers, rubber, neoprene, silicon rubber, other elastomers, or combinations thereof. In some examples, which can be combined with other examples herein, the flexible body 102 can be formed from materials that are transparent, semi-transparent, or opaque. In some aspects of the first ultrasonic device 100A, the flexible body 102 may or may not include dyes to give the flexible body 102 a colorized appearance.

The plurality of ultrasonic transducers 116 is shown as being six in number in FIG. 1A. In other examples, which can be combined with other examples herein, the plurality of ultrasonic transducers 116 can be from two to twelve or more. The number of ultrasonic transducers 116 used can be selected based on factors including an average diameter of the flexible body 102, a length 126 of the flexible body 102 as measured from the first end 104 to the second end 108, a material from which the flexible body 102 is formed, the material from which the transducers 116 are formed, a size of the transducers, or other factors or combinations of factors. The plurality of ultrasonic transducers 116 can be coupled to the outside surface 114 of the flexible body 102. In other examples, the plurality of ultrasonic transducers 116 can be coupled to the inside surface 112 of the flexible body 102. In other examples, the plurality of ultrasonic transducers 116 can be partially of wholly embedded in the flexible body 102, either during or after the fabrication of the flexible body 102.

The plurality of ultrasonic transducers 116 can be configured to operate at the same frequency, or one or more of the plurality of the ultrasonic transducers 116 can be configured to operate at a different frequency. In some examples, the plurality of ultrasonic transducers 116 a frequency from about 20 kilo-hertz (KHz) to about 100 KHz. In other examples, the plurality of ultrasonic transducers 116 can be configured to operate at a frequency from about 20 kilo-hertz (KHz) to about 80 KHz. In still other examples, the plurality of ultrasonic transducers 116 can be configured to operate at a frequency from about 30 kilo-hertz (KHz) to about 70 KHz. The plurality of ultrasonic transducers 116 can be formed from quartz having a single crystalline structure, lead zirconate titanate, lithium niobate, tourmaline, or combinations thereof. The type of ultrasonic transducers 116, as well as the operation frequency, and/or the range of frequencies among and between each of the plurality of ultrasonic transducers 116, may be selected based on factors including an average diameter of the flexible body 102, a length 126 of the flexible body 102 as measured from the first end 104 to the second end 108, a material from which the flexible body 102 is formed, a wall thickness of the flexible body 102, the material from which the transducers 116 are formed, a size or geometry of the transducers, or other factors or combinations of factors.

In some examples, the first ultrasonic device 100A can further include one or more first heating elements 122. In one example, as shown in FIG. 1A, the one or more first heating elements 122 can be individually coupled to the inside surface 112 of the flexible body 102, the outside surface 114, or may be embedded within the flexible body 102, or combinations thereof. While four of the first heating elements 122 are shown in FIG. 1A, in other examples, less first heating elements 122 can be used in the first ultrasonic device 100A. In still other examples, more than four first heating elements 122 can be used in the ultrasonic device 100A. The one or more first heating elements 122 may be included in the first ultrasonic device 100A as one or more coils. In another example, a second heating element 120, which can configured as a linear heating element and may be used alone or in combination with other examples herein, can be positioned through the hollow passage 118 of the flexible body 102. The one or more first heating elements 122 and/or the second heating element 120 can be configured to heat the first ultrasonic device 100A, and thus the environment and/or components in which the first ultrasonic device 100A is disposed within, to temperatures from about room temperature to about 80° C. As used herein, "room temperature" means a temperature from about 20° C. to about 23° C.

In some examples, the first ultrasonic device 100A can include one or more positioning elements 124. The one or more positioning elements 124 can be coupled to the inside surface 112, the outside surface 114, embedded in the flexible body 102, or combinations thereof. The at least one positioning element 124 is configured to maintain a position of the flexible body 102 relative to a component (not shown here) to be processed by the ultrasonic system which includes the first ultrasonic device 100A. The positioning element 124 may include a metallic or other type of element that enables the flexible body 102 to be configured and positioned in various geometries. In some examples, the positioning element 124 may be used alone to position the flexible body 102 relative to a component to be cleaned. In other examples, one or more types of support structures discussed herein may be used alone or in conjunction with the positioning element(s) 124 to position the flexible body relative to the component to be cleaned.

Figure 1B:
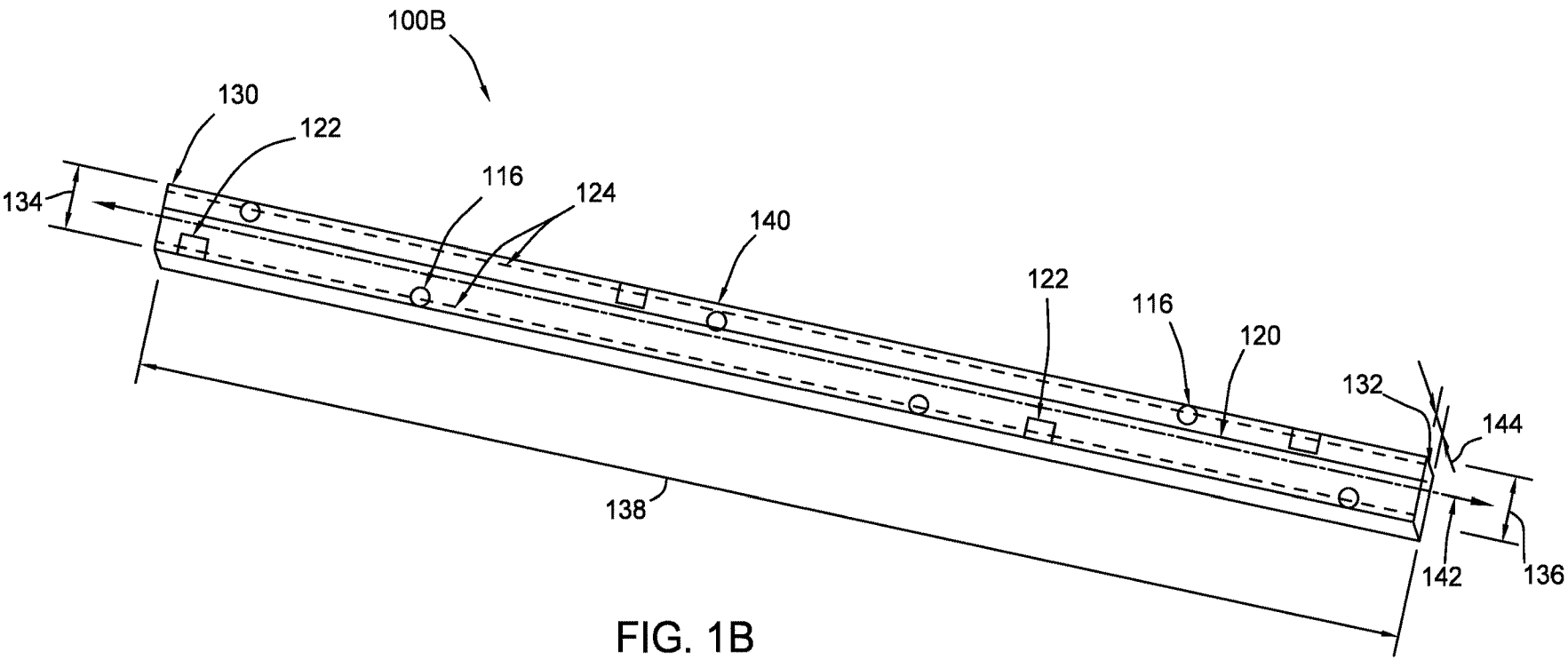
FIG. 1B depicts a second ultrasonic device according to aspects of the present disclosure.

FIG. 1B depicts a second ultrasonic device 100B according to aspects of the present disclosure. In contrast to the first ultrasonic device 100A, which may be configured as a cylinder that may or may not include a hollow passageway, the second ultrasonic device 100B is configured as a belt. In FIG. 1B, the second ultrasonic device 100B is shown as having a rectangular cross-section as measured perpendicular to a central axis 142. In other aspects, the second ultrasonic device 100B can have a cross-section that is triangular, square, circular, or other polygonal or combination of geometries. The second ultrasonic device 100B includes a flexible body 140 and a plurality of ultrasonic transducers 116 coupled to the flexible body 140. The flexible body 140 has a first end 130 having a first outside diameter 134 and a second end 132 opposite the first end 130, the second end 132 having a second outside diameter 136. The first outside diameter 134 may be the same as the second outside diameter 136. In other examples, the second ultrasonic device 100B may have a tapered outside diameter such that the first outside diameter 134 may be greater to or less than the second outside diameter 136.

The flexible body 140 has a length 138 measured from the first end 130 to the second end 132 and a thickness 144 measured perpendicular to the central axis 142. The thickness 144 may be consistent along the length 138 of the flexible body 140. In other examples, the thickness 144 may taper such that the first end 130 is thicker than the second end 132, or such that the first end 130 is thinner than the second end 132. In one example, the first end 130 may differ in thickness from the second end 132 from about 5% to about 90%. In another example, the first end 130 may differ in thickness from the second end 132 from about 20% to about 75%. In still another example, the first end 130 may differ in thickness from the second end 132 from about 35% to about 50%.

The flexible body 140 can be formed from materials of varying rigidity, including polymers, rubber, neoprene, silicon rubber, other elastomers, or combinations thereof. The flexible body 140 can, in some aspects of the second ultrasonic device 100B, be formed from materials that are transparent, semi-transparent, or opaque. In some examples, the flexible body 140 may or may not include dyes to give the flexible body 140 a colorized appearance.

The plurality of ultrasonic transducers 116 is shown as being six in number in FIG. 1B. In other examples, which can be combined with other examples herein, the plurality of ultrasonic transducers 116 can be from two to twelve or more. The number of ultrasonic transducers 116 used can be selected based on factors including an average diameter of the flexible body 140, the length 138 of the flexible body 140 as measured from the first end 130 to the second end 132, a material from which the flexible body 140 is formed, the material from which the ultrasonic transducers 116 are formed, a size of the ultrasonic transducers 116, or other factors or combinations of factors. The plurality of ultrasonic transducers 116 can be coupled to one or more surfaces of the flexible body 140. In other examples, the plurality of ultrasonic transducers 116 can be partially of wholly embedded in the flexible body 140.

The plurality of ultrasonic transducers 116 can be configured to operate at a frequency from about 20 kilo-hertz (KHz) to about 100 KHz. In other examples, the plurality of ultrasonic transducers 116 can be configured to operate at a frequency from about 20 kilo-hertz (KHz) to about 80 KHz. In still other examples, the plurality of ultrasonic transducers 116 can be configured to operate at a frequency from about 30 kilo-hertz (KHz) to about 70 KHz. The plurality of ultrasonic transducers 116 can be formed from quartz having a single crystalline structure, lead zirconate titanate, lithium niobate, tourmaline, or combinations thereof. The type of ultrasonic transducers 116, as well as the operation frequency, and/or the range of frequencies among and between each of the plurality of ultrasonic transducers 116, may be selected based on factors including an average diameter of the flexible body 140, the length 138 of the flexible body 140 as measured from the first end 130 to the second end 132, a material from which the flexible body 140 is formed, the material from which the ultrasonic transducers 116 are formed, a size of the ultrasonic transducers 116, or other factors or combinations of factors.

In some examples, the second ultrasonic device 100B can further include one or more first heating elements 122. In one example, as shown in FIG. 1A, the one or more first heating elements 122 can be configured as elements individually coupled to one or more surfaces of the flexible body 140, embedded within the flexible body 140, or combinations thereof. While four first heating elements 122 are shown in FIG. 1B, in other examples, less first heating elements 122 can be used in the second ultrasonic device 100B. In still other examples, more than four first heating elements 122 can be used in the ultrasonic device 122. The one or more first heating elements 122 may also be included in the second ultrasonic device 100B as one or more coils. In another example, a second heating element 120, which can be combined with other examples herein, can be positioned through the hollow passage 118 of the flexible body 140. In one example, the second heating element 120 may be a linear heating element. In other examples, the second heating element 120 may be otherwise configured, for example, such as a coil configuration. The one or more first heating elements 122 and/or the second heating element 120 can be configured to heat the second ultrasonic device 100B, and thus the environment and/or components in which the second ultrasonic device 100B is positioned in proximity to, to heat the environment and/or components to temperatures from about room temperature to about 80° C. As used herein, "room temperature" means a temperature from about 20° C. to about 23° C.

Figure 4:
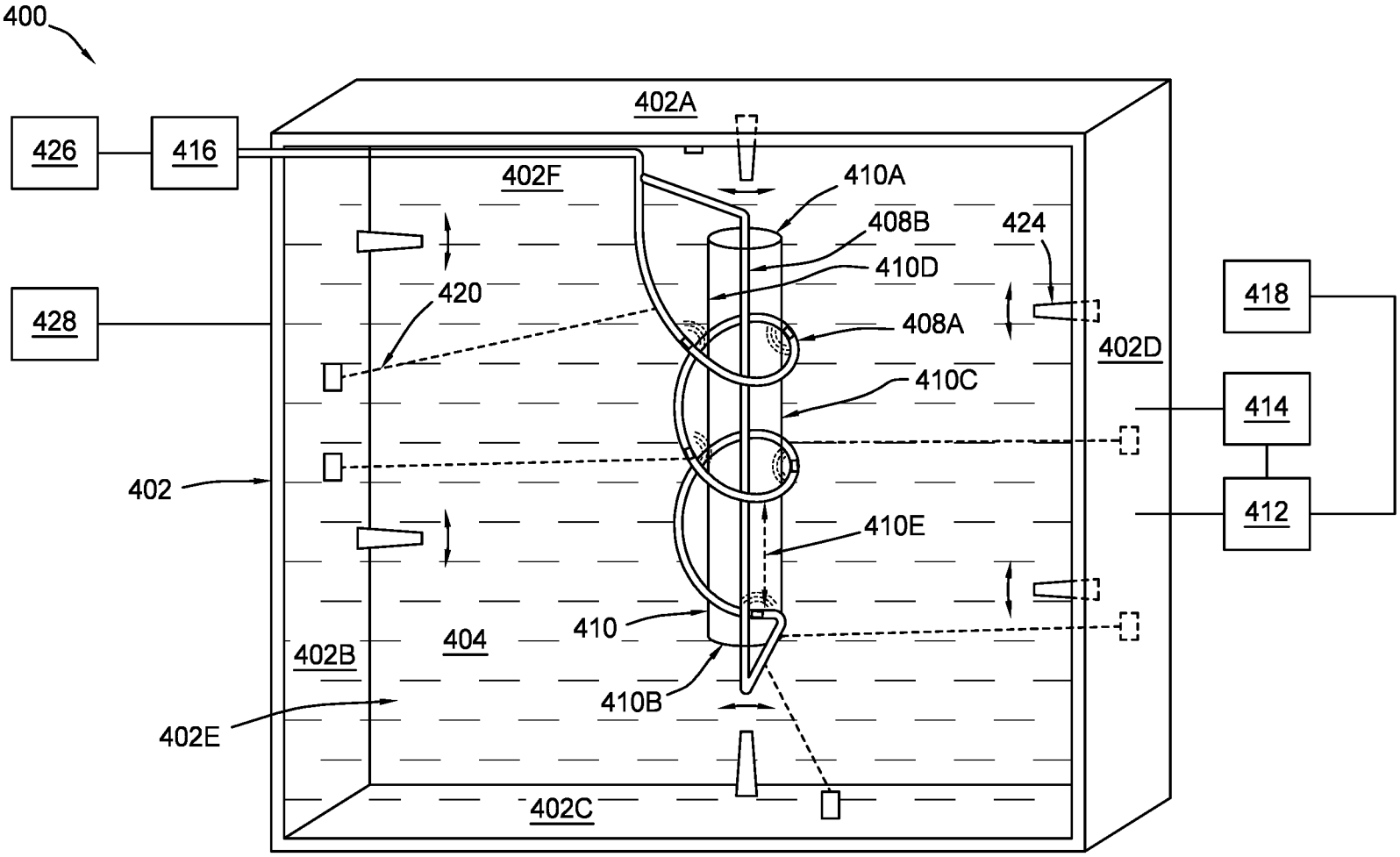
FIG. 4 depicts an illustration of an example ultrasonic system according to aspects of the present disclosure.

In some examples, the second ultrasonic device 100B can include one or more positioning elements 124. The one or more positioning elements 124 can be coupled to one or more surfaces of the flexible body 140, embedded in the flexible body 140, or combinations thereof. The at least one positioning element 124 is configured to maintain a position of the flexible body 140 relative to a component (not shown here) to be processed by the ultrasonic system which includes the second ultrasonic device 100B. The second ultrasonic device 100B may be used in applications where cleaning operations are performed in a tank (as shown in FIG. 4), or in mixing operations where homogenous mixtures are formed in processing vessels, or in other operations including but not limited to cleaning operations where factors including a geometry of the component(s) being cleaned or other factors may make the second ultrasonic device 100B desirable.

Figure 2:
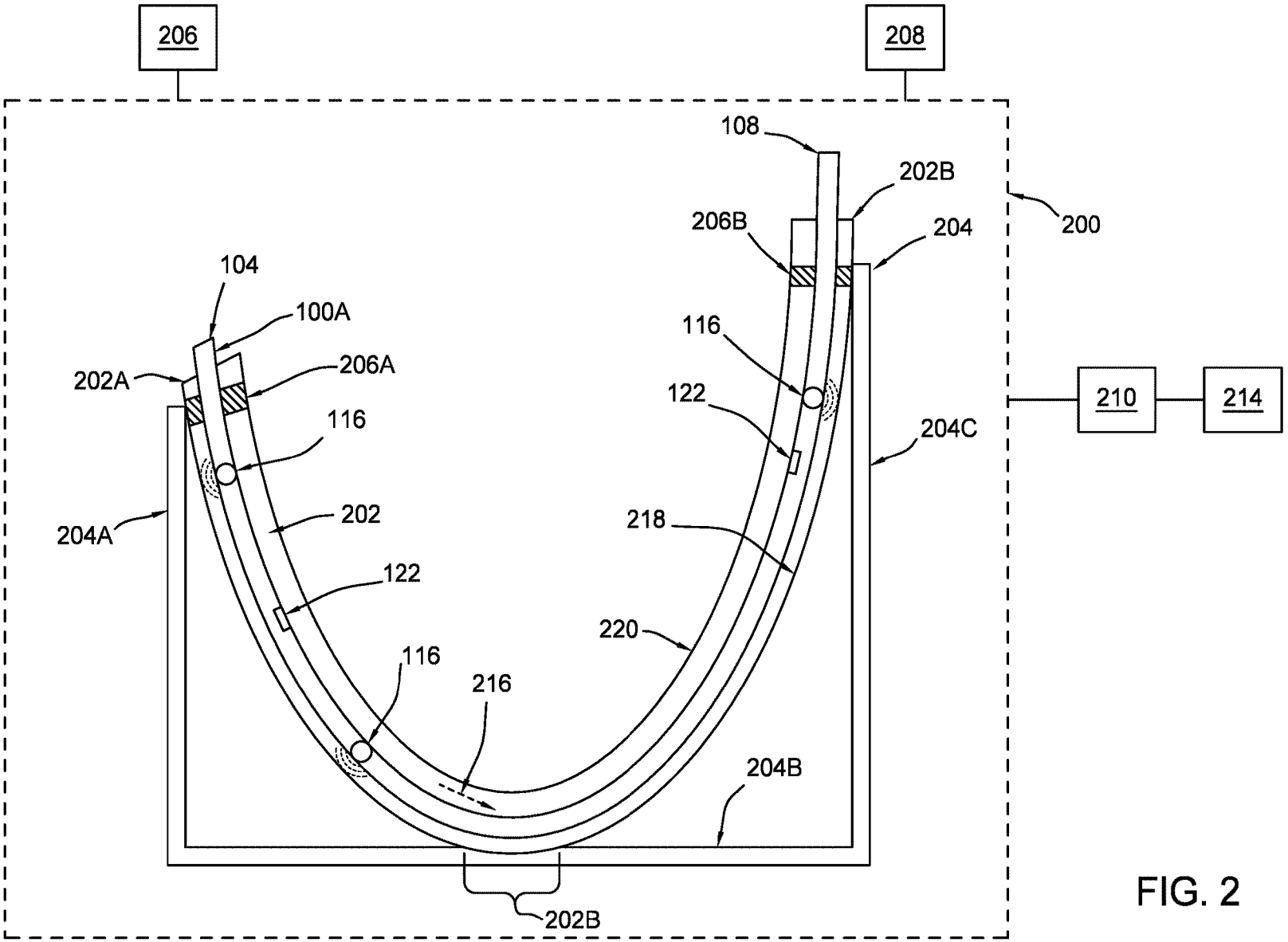
FIG. 2 depicts an example ultrasonic system according to aspects of the present disclosure.
Figure 3:
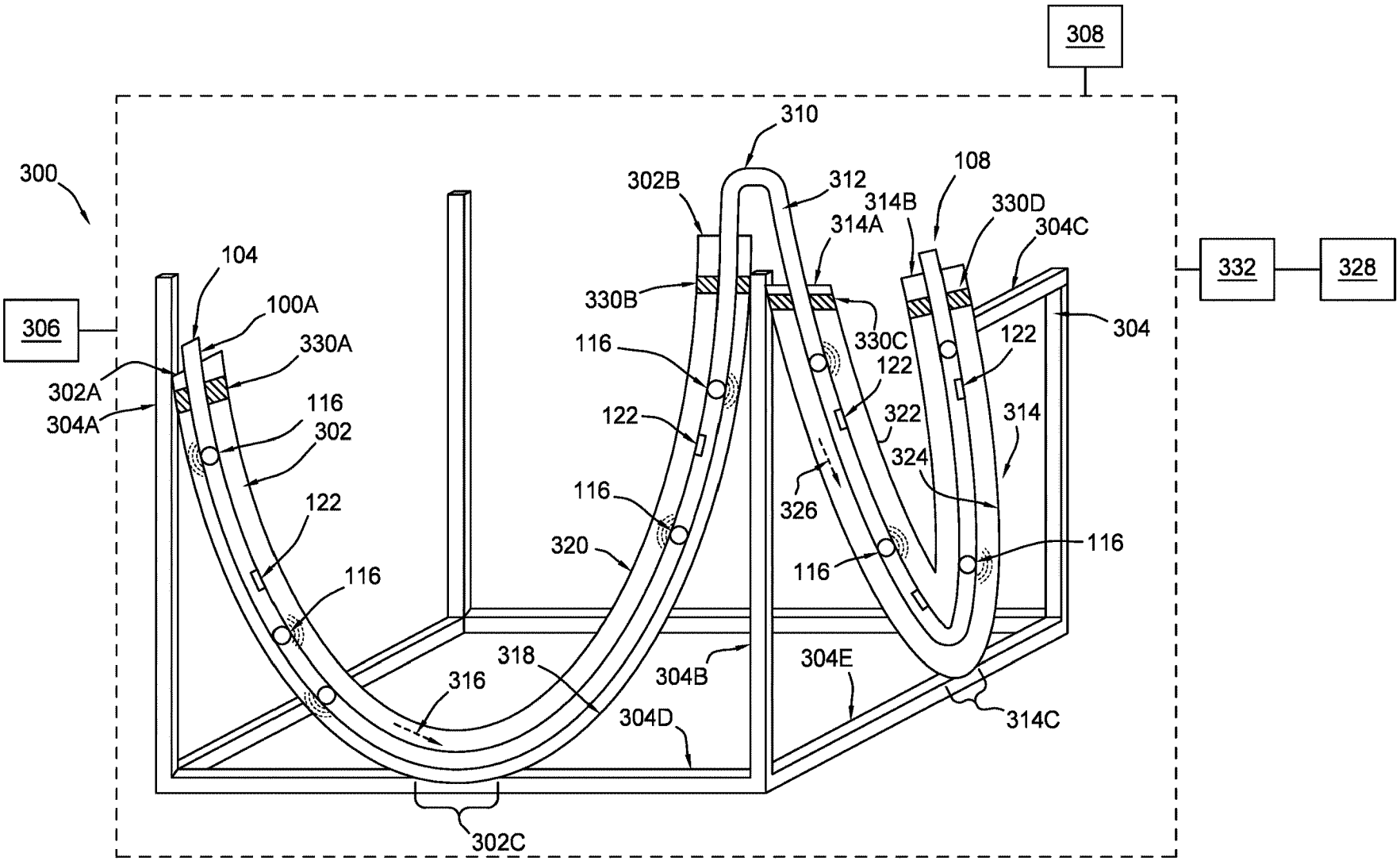
FIG. 3 depicts an example ultrasonic system according to aspects of the present disclosure.

The ultrasonic devices 100A and 100B can be disposed in various systems and/or otherwise removably coupled to components to be cleaned. FIGS. 2, 3, and 4 are examples of systems that may include one or more of the ultrasonic devices 100A or 100B discussed above. As used herein, a first component such as an ultrasonic device can be "removably coupled" to a second component such as a component to be cleaned or another ultrasonic device such that the uncoupling of the two does not damage either, such that the ultrasonic device(s) can be recoupled to another component to be cleaned or to another ultrasonic device, and the cleaned component can be further processed and/or assembled or reassembled into industrial equipment.

Example Systems Including Ultrasonic Devices

FIG. 2 is an example ultrasonic system 200 according to aspects of the present disclosure. FIG. 2 shows the first ultrasonic device 100A coupled to a support structure 204. The first ultrasonic device 100A is disposed through a component 202. The component 202 can be formed from one or more polymer, metallic, or composite materials and may be of varying outside and inside diameters and wall thicknesses, including tapered outside or inside diameters or tapered wall thickness. The component has a first end 202A and a second end 202B, an inside surface 218, and an outside surface 220 extending from the first end 202A to the second end 202B. The inside surface 218 defines an inside passage 216 through which the first ultrasonic device 100A is positioned. In some examples, the component 202 can include a coating and/or three-dimensional structures on the inside surface 218, such as nano-, micro-, or macro-sized features extending along some or all of the inside surface 218. A nano-sized feature includes a feature having a maximum dimension of about 100 nm, and a macro-sized feature is a feature having a minimum dimension that can be seen without magnification, including the magnification of prescription eyewear. Micro-sized features are features having a minimum dimension greater than 101 nm but which may not be visible without magnification. In some examples, which can be combined with other examples of ultrasonic devices herein, the outside surface 220 can include a coating and/or three-dimensional structures having nano-, micro-, or macro-sized features extending along some or all of the outside surface 220.

The first ultrasonic device 100A can include the plurality of ultrasonic transducers 116 discussed above. In some examples of the ultrasonic system 200, one or more first heating elements 122, or other heating elements such as the second heating element 120 discussed above, can be further included in the first ultrasonic device 100A. The support structure 204 is shown as an open structure having a first side 204A, a bottom 204B, and a second side 204C. In one example, the first coupling mechanism 206A is configured to secure the first end 104 of the first ultrasonic device 100A to the first end 202A of the component 202, and may be positioned at various locations at or near the first end 202A. In some examples, which can be combined with other examples discussed herein, first coupling mechanism 206A can be further configured to be secured to the support structure 204, for example, via the first side 204A. The second coupling mechanism 206B is configured to secure the second end 108 of the first ultrasonic device 100A to the second end 202B of the component 202, and may be positioned at various locations at or near the second end 202B. In some examples, which can be combined with other examples herein, the second coupling mechanism 206B can be further configured to be secured to the support structure 204, for example, via the second side 204D.

In some examples, each of the first coupling mechanism 206A and the second coupling mechanism 206B includes two or more elements, each element being configured to (a) secure the first ultrasonic device 100A to the component 202 or (b) secure the component 202 to the support structure 204. The coupling mechanisms 206A, 206B can include mechanical means such as clamps, press-fit, magnetic closures, or other means or combinations of means such that the coupling mechanisms 206A, 206B removably couple the first ultrasonic device 100A to the component 202 to remove debris from the inside passage 216. In some examples, the entirety of the outside surface 220 can be suspended via the coupling mechanisms 206A, 206B. In still other examples, other portions of the component 202 can be secured to the support structure 204 using additional coupling mechanisms (not shown here). In other examples, one or more portions of the outside surface 220 may be in contact with and supported by the support structure 204 without use of coupling mechanisms. In one such example, the contact portion 202C of the component 202 is in contact with the bottom 204B of the support structure 204. In this example, the contact portion 202C may be secured in place by tension on the component 202 created via the use of the first coupling mechanism 206A and the second coupling mechanism 206B.

The first side 204A and the second side 204C of the support structure 204 can be removably coupled to the bottom 204B. While the first side 204A is shown as being substantially parallel to the second side 204C, in other examples, the two sides can be configured relative to each other at different angles other than the parallel configuration. The first side 204A and the second side 204C of the support structure 204 are shown in FIG. 2 as being substantially perpendicular to the bottom 204B of the support structure 204. In other examples, one or both of the first side 204A and the second side 204C can be configured at other angles relative to the bottom 204B. Further, in other examples, a top support (not shown here) can be used as a part of the support structure 204. This top support could be removably coupled to one or more of the first side 204A and the second side 204C, or the bottom 204B at various angles, and may be coupled to the component 202 and/or the first ultrasonic device 100A.

The ultrasonic system 200 can further include a fluid vessel 206, a waste vessel 208, and a power supply 210. The fluid vessel 206 and the waste vessel 208 are shown as being separate vessels in FIG. 2. In other examples, a single system may include both the fluid vessel 206 and the waste vessel 208. In still other examples, a single system may further include a filtering system (not shown here) to recycle the waste fluid from the waste vessel 208. A plurality of logic stored in a non-transitory computer-readable medium can be in wired or wireless communication with elements of the ultrasonic system 200. The plurality of logic can be stored in a non-transitory computer-readable medium such as indicated by element 214, and can control, for example, a speed and direction of fluid flow from the fluid vessel 206 through the inside passage 216 to the waste vessel 208, such that the fluid is in contact with the inside passage 216 and the first ultrasonic device 100A. The fluid stored in the fluid vessel 206 may include water, surfactant, a degreasing liquid, a degreasing gas, ambient air, nitrogen, $CO_2$, and combinations thereof. The fluid vessel 206, or other fluid vessels discussed herein, can be configured to direct fluid towards the outside surface 220 or the inside surface 218, for example, to create a directional flow including a swirling flow around the outside surface 220 or through the inside surface 218 of the component 202.

In one example, the fluid can be heated in the fluid vessel 206 to a temperature from about room temperature (about 20° C. to about 23° C.) to about 80° C. The fluid may be brought to and held at a predetermined temperature, or ramped up and/or down to various temperatures, to aid in cleaning, mixing, or other operations performed by the systems discussed herein which include ultrasonic devices. In another example, which can be combined with other examples herein, the fluid can be heated by the one or more first heating elements 122 to a temperature from about room temperature to about 80° C., instead of or in addition to being heated while in the fluid vessel 206. In another example, the temperature of the fluid established via the plurality of first heating elements 122 or in the fluid vessel may be from about 30° C. to about 70° C. In another example, the temperature of the fluid established via the one or more first heating elements 122 or in the fluid vessel may be from about 35° C. to about 60° C.

The plurality of logic can be in the form of one or more programs such as cleaning programs that control the fluid flow volume from the fluid vessel 206, a time for fluid flow to remain in the inside passage before being moved to the waste vessel 208, a frequency range for the one or more of the plurality of transducers 116, a temperature range, ramp up, and ramp down for the one or more of the one or more first heating elements 122, as well as other parameters and combinations of parameters. In one example, the waste vessel 208 can be configured to filter contaminants removed from the inside (internal) passage 216 and return filtered fluid to the fluid vessel 206 which can be re-used during the cleaning of the component 202 or subsequent components. In another example, the waste vessel 208 (or other waste vessels discussed herein) can be configured to collect the fluid supplied to the ultrasonic device 100A from the fluid vessel 206. In some examples, the fluid vessel 206 includes a plurality of partitions, each of which includes one or more types (compositions) of cleaning fluid, which can be used alone or in combination with one or more types of cleaning fluid. Regardless of whether or not the cleaning fluid is recycled, one or more cycles of cleaning may be executed via a cleaning program, wherein each cleaning cycle in the cleaning program includes a transfer of a predetermined volume of cleaning fluid from the fluid vessel 206 to the waste vessel 208. A cleaning cycle may be defined by moving a predetermined volume of fluid from the fluid from the fluid vessel 206 through the component 202. Depending upon factors including a geometry of the component 202, an inside passage 218 configuration (geometry) of the component 202, a surface roughness, smoothness, or other features of the inside surface 216 or outside surface 220 of the component, the predetermined volume included in each cycle may be from about 5% to about 100% of the fluid (liquid, gas, particles, or combinations thereof) disposed in the fluid vessel 206.

The ultrasonic system 200 in FIG. 2 may be used for cleaning components when a low-solvent cleaning method is desired, and/or when cleaning one or more inside passages is desired. The first ultrasonic device 100A is shown as being positioned through the inside passage 216 of the component. In some examples, the fluid vessel 206 may include one or more gases, such as $CO_2$ as discussed above, such that the gas is flowed through the component 202 to remove contaminants dislodged via the first ultrasonic device 100A. In this example, the ultrasonic system 200 can be configured to perform solvent-free cleaning operations.

The ultrasonic system 200 is shown in FIG. 2 as being configured to clean one component 202. In other examples, ultrasonic systems discussed herein may be configured to clean two or more component simultaneously. One such example of a multi-component-cleaning ultrasonic system is shown and discussed below in FIG. 3.

FIG. 3 is an example ultrasonic system 300 according to aspects of the present disclosure. The ultrasonic system 300 of FIG. 3, which may be referred to as a cleaning system, is similar to the ultrasonic system 200 of FIG. 2, but it includes an additional ultrasonic device and an expanded support structure and is configured to clean a first component 302 and a second component 314. FIG. 3 shows the first ultrasonic device 100A coupled to a support structure 304. While a single first ultrasonic device (100A) is shown in FIG. 3 as being configured to clean the first component 302 and the second component 314, in other examples, two or more ultrasonic devices may be used to clean two or more components. In other examples, the first ultrasonic device 100A can be used to clean three or more components. In still other examples, other forms of ultrasonic devices discussed herein may be configured in the ultrasonic system 300 of FIG. 3 (e.g., the ultrasonic devices discussed in FIG. 1B or FIG. 4).

The first ultrasonic device 100A is positioned through an inside passage 316 of a component 302. The first component 302 can be formed from one or more polymer, metallic, or composite materials and may be of varying outside and inside diameters and wall thicknesses, including tapered outside or inside diameters or tapered wall thickness. The component has a first end 302A and a second end 302B, an inside surface 318, and an outside surface 320 extending from the first end 302A to the second end 302B. The inside surface 318 defines the inside passage 316 through which the first ultrasonic device 100A is positioned.

The first ultrasonic device 100A can include the plurality of ultrasonic transducers 116 discussed above. In some examples of the ultrasonic system 300, one or more of the plurality of first heating elements 122 can be further included in the first ultrasonic device 100A. The support structure 304 is shown as an open structure having a plurality of connected portions, including a first side portion 304A, a second side portion 304B, and a third side portion 304C. The support structure 304 may further include a first bottom portion 304D and a second bottom portion 304E. In other examples, the support structure 304 may include additional portions configured in various manners to support one or more components (e.g. 302).

The first coupling mechanism 330A is configured to secure the first end 302A of the first ultrasonic device 100A to the first end 302A of the first component 302, and may be positioned at various locations at or near the first end 302A. The first coupling mechanism 330A can be secured to the support structure 304, for example, via a first side portion 304A of the support structure 304. The second coupling mechanism 330B may be configured to secure the first ultrasonic device 100A to the second end 302B of the first component 302, and may be positioned at various locations at or near the second end 302B. The second coupling mechanism 330B can be further configured to secure the first component 302 to the support structure 304, for example, via the second side portion 304B. In some examples, each of the first coupling mechanism 330A and the second coupling mechanism 330B includes two or more elements, each element being configured to (a) secure the first ultrasonic device 100A to the first component 302 or (b) secure the first component 302 to the support structure 304.

In some examples, the entirety of the outside surface 320 of the first component 302 can be suspended via the coupling mechanisms 330A, 330B. In still other examples, other portions of the first component 302 can be secured to the support structure 304 using additional coupling mechanisms (not shown here). In other examples, one or more portions of the outside surface 320 may be in contact with and supported by the support structure 304 without use of coupling mechanisms. In one such example, a contact portion 302C of the first component 302 is in contact with a first bottom portion 304D of the support structure 304. The contact portion 302C is referred to as such as it is a portion of the first component 302 that may be in contact with the support structure 304 to stabilize or otherwise facilitate cleaning of the first component 302. In this example, the contact portion 302C may be secured in place by tension on the first component 302 created via the use of the first coupling mechanism 330A and the second coupling mechanism 330B. In other examples, which can be combined with other aspects discussed herein, the contact portion 302C may be secured in place using one or more coupling mechanisms (not shown here).

The ultrasonic system 300 is further configured to have the second component 314 coupled thereto. The second component 314 is shown as being configured similarly to the first component 302 for ease of illustration, but may, in other examples, have multiple twists, turns, and bends in various directions. The first ultrasonic device 100A has a portion 310 extending between the first component 302 and the second component 314. The second component 314 has a first end 314A, a second end 314B, an outside surface 322, and an inside surface 324 defining an inside passage 326 through which the first ultrasonic device 100A is positioned.

A third coupling mechanism 330C is configured to secure the first end 314A of the first ultrasonic device 100A to the first end 314A of the second component 314, and may be positioned at various locations at or near the first end 314A. The third coupling mechanism 330C can be secured to the support structure 304, for example, via the second side portion 304B of the support structure 304. A fourth coupling mechanism 330D may be configured to secure the first ultrasonic device 100A to the second end 314B of the second component 314, and may be positioned at various locations at or near the second end 314B. The fourth coupling mechanism 330D can be further configured to secure the second component 314 to the support structure 304, for example, via the third side portion 304C. The third side portion 304C is an example of a portion of the support structure 304 that includes multi-directional features to accommodate components of varying geometries. In some examples, each of the third coupling mechanism 330C and the fourth coupling mechanism 330D includes two or more elements, each element being configured to (a) secure the first ultrasonic device 100A to the second component 314 or (b) secure the second component 314 to the support structure 304.

In some examples, the entirety of the outside surface 322 of the second component 314 can be suspended via the coupling mechanisms 330C, 330D such that the bottom portion 314C. In still other examples, other portions of the second component 314 can be secured to the support structure 304 using additional coupling mechanisms (not shown here). In other examples, one or more portions of the outside surface 322 may be in contact with and supported by the support structure 304 without use of coupling mechanisms. In one such example, a contact portion 314C of the second component 314 is in contact with a second bottom portion 304E of the support structure 304. In this example, the contact portion 314C may be secured in place by tension on the second component 314 created via the use of the third coupling mechanism 330C and the fourth coupling mechanism 330D.

The coupling mechanisms 330A, 330B, 330C, and 330D can include mechanical means such as clamps, press-fit, magnetic closures, or other means or combinations of means such that the coupling mechanisms 330A, 330B, 330C, and 330D removably couple the first ultrasonic device 100A to the first component 302 and the second component 314 to remove debris from the inside passages 316, 326, respectively.

The ultrasonic system 300 can further include a fluid vessel 306, a waste vessel 308, and a power supply 332. The fluid vessel 306 may be configured to supply fluid to the first component 302, such that the fluid flows through the first component 302 either from the first end 302A to the second end 302B or from the second end 302B to the first end 302A.

The fluid stored in the fluid vessel 306 may include water, surfactant, a degreasing liquid, a degreasing gas, ambient air, nitrogen, $CO_2$, and combinations thereof. In some examples, a plurality of particles may be present in the fluid stored in the fluid vessel 306, these particles may be used to aid in the cleaning process. A plurality of logic stored in a non-transitory computer-readable medium can be in wired or wireless communication with elements of the ultrasonic system 300. The plurality of logic can be stored in a non-transitory computer-readable medium such as indicated by element 328, and can control, for example, a speed and direction of fluid flow from the fluid vessel 306 through the inside passage 316 of the first component 302 and into to the waste vessel 308, such that the fluid is in contact with the inside passage 316 of the first component 302 and the first ultrasonic device 100A. The fluid vessel 306 may be further configured to supply fluid to the second component 314, such that the fluid flows through the second component 314 either from the first end 314A to the second end 314B or from the second end 314B to the first end 314A through the inside passage 326 of the second component 314 where the first ultrasonic device 100A is positioned. In one example, the fluid can be heated in the fluid vessel 306 to a temperature from about room temperature to about 80° C. In another example, which can be combined with other examples herein, the fluid can be heated by the plurality of first heating elements 122 to a temperature from about room temperature to about 80° C., instead of or in addition to being heated while in the fluid vessel 306. The waste vessel 308 may be coupled to each of the first component 302 and the second component 314 at one or both ends in order to collect the waste fluid.

The plurality of logic can be in the form of one or more cleaning programs or other programs that control factors including: the fluid flow volume from the fluid vessel 306, a time for fluid flow to remain in the inside passage before being moved to the waste vessel 308, a frequency range for the one or more of the plurality of transducers 116, a temperature range, ramp up, and ramp down for the one or more of the plurality of first heating elements 122, as well as other parameters and combinations of parameters. In one example, the waste vessel 308 can be configured to filter contaminants removed from the inside passage of the first component 302 and/or the second component 314 and return filtered fluid to the fluid vessel 306 which can be re-used during the cleaning of the first component 302, the second component 314, or components cleaned in subsequent cleaning cycles. In some examples, the fluid vessel 306 includes a plurality of partitions, each of which includes one or more types (compositions) of cleaning fluid, which can be used alone or in combination with one or more types of cleaning fluid. Regardless of whether or not the cleaning fluid is recycled, one or more cycles of cleaning may be executed via a cleaning program, wherein each cleaning cycle in the cleaning program includes a transfer of a predetermined volume of cleaning fluid from the fluid vessel 306 to the waste vessel 308.

FIG. 3 shows the first ultrasonic device 100A positioned relative to the first component 302 and the second component 314. In other examples, two or more ultrasonic devices and/or components may be coupled to an ultrasonic system, such as a cleaning system. In some examples, each component may have an ultrasonic device coupled thereto. Further, in either of the ultrasonic systems 200 or 300, one or more of the first ultrasonic devices 100A may be removably coupled to the outside surface(s) of the components. In still other aspects of the present disclosure, in either of the ultrasonic systems 200 or 300, one or more of the first ultrasonic devices 100A may be removably coupled to both the outside surface and the inside passageway of the components. In other examples, two or more components may share a single ultrasonic device. The ultrasonic system 300 of FIG. 3 may be used, for example, when multiple components are to be cleaned simultaneously, or when multiple components may be cleaned in a staggered or overlapping series of cleaning processes. In still other examples, the second ultrasonic device 100B may be used in place of the first ultrasonic device 100A in either of the ultrasonic systems shown in FIGS. 2 and 3.

FIG. 4 depicts an illustration of an ultrasonic system 400 according to aspects of the present disclosure. In contrast to the ultrasonic systems 200 and 300 discussed above, the ultrasonic system 400 includes a tank 402 having liquid 404 therein, which is a liquid that may or may not have gas bubbled therethrough, in contrast to the fluids discussed herein that may take the form of a liquid or a gas. The tank 402 may have one or more access points, which may include the movement of a side of a tank, a portion of a side of a tank, or a combination of sides and portions of sides of the tank, to enable the positioning of components therein. The one or more access points may be hinged, magnetized, latched, or otherwise secured and unsecured to both allow the positioning of one or more components prior to and subsequent to processing, while containing the liquid 404 therein. The ultrasonic system 400 may be used, for example, when it is desirable to clean a component by submerging the component in fluid in order to more readily remove contaminants from the outside surface or the inside passage (or both simultaneously). Accordingly, the component 410 positioned in the tank 402 can be cleaned using the liquid 404. While FIG. 4 illustrates the component 410 positioned therein, the component 410 is shown for illustrative purposes as the system 400 is fabricated and sold without the component 410 being positioned therein. The component 410 includes a first end 410A, a second end 410B, an outside surface 410C, and an inside surface 410D defining an inside passage 410E extending from the first end 410A to the second end 410B. In some examples, a fluid vessel 428 may optionally be included in the ultrasonic system 400. The fluid vessel 428 may be included, for example, to introduce a different type of fluid than the liquid 404 included in the tank 402, or to introduce new fluid to the tank 402. While the system 400 is shown as having a single component (410) positioned therein, in other examples, two or more components of varying geometries may be positioned in the tank 402.

The tank 402 can be defined by a plurality of sides, 402A, 402B, 402C, 402D, 402E, and 402F. The tank 402 may be fabricated from various metals such as steel, stainless steel, aluminum, glass, polymer(s), or other materials or combinations of materials. One or more sides (402A-402F) may have heating elements (not shown) embedded within or removably coupled thereto. As illustrated in FIG. 4, at least the front side 402E is illustrated as being formed from a transparent or semi-transparent material. In other examples, one or more of the plurality of sides (402A, 402B, 402C, 402D, 402E, 402F) may include a portion formed from a transparent material. This may be, for example, to enable viewing of the cleaning process. The tank 402 has a plurality of liquid 404 disposed therein. The f liquid 404 may be disposed in any volume of the tank 402, up to and including the entire volume of the tank 402. The liquid 404 may include water, include water, surfactant, a degreasing liquid, and combinations thereof. In some examples, the liquid 404 may include a plurality of gas fed into the tank 402, which may include a degreasing gas, ambient air, nitrogen, $CO_2$, or combinations thereof. In some examples, a plurality of particles may be present in the fluid stored in the tank 402, these particles may be used to aid in the cleaning process. The system 400 may additionally include a fluid vessel 428 that may be configured to supply fluid to the tank 402. The fluid stored in the fluid vessel 428 may be the same as the liquid 404 in the tank 402. In other examples, the fluid stored in the fluid vessel 428 may be different than the liquid 404 in the tank 402. The fluid vessel 428 may include water, include water, surfactant, a degreasing liquid, a degreasing gas, ambient air, nitrogen, $CO_2$, and combinations thereof. In some examples, a plurality of particles may be present in the fluid stored in the fluid vessel 428, these particles may be used to aid in the removal of contaminants during the cleaning process.

Two ultrasonic devices are shown in FIG. 4. A first ultrasonic device 408A may be configured similarly to the ultrasonic device 100B show in FIG. 1B. The first ultrasonic device 408A may be configured to couple to the outside surface 410C of the component 410 to clean the outside surface 410C. In some aspects of the ultrasonic system 400, the first ultrasonic device 408A may be used alone. In other aspects of the ultrasonic system 400, the first ultrasonic device 408A may be used in combination with a second ultrasonic device 408B. In still other aspects of the ultrasonic system 400, the first ultrasonic device 408A may be used in combination with the second ultrasonic device 408B. In still other aspects of the ultrasonic system 400, two or more of the first ultrasonic device 408A and/or the second ultrasonic device 408B may be used to clean one or more components. The second ultrasonic device 408B may be configured similarly to the ultrasonic device 100A in FIG. 1A. Accordingly, the second ultrasonic device 408B may be positioned in the inside passage 410E of the component 410 to remove contaminants from the inside passage 410E.

The tank 402 can further include a support structure 420. The support structure 420 may be configured to couple to one or both of the component 410 or the ultrasonic devices (408A, 408B). The tank 402 can further include a plurality of nozzles 424 configured to be adjustable such that the plurality of nozzles 424 can direct the liquid 404 (and/or the fluid, which may include a liquid, gas, or combinations thereof which may or may not include particles, from the fluid vessel 428) at the outside surface 410C of the component 410 and/or through the inside passage 410E of the component 410 to remove contaminants. In some examples, the support structure 420 can be configured to position the plurality of ultrasonic transducers of the first or second ultrasonic devices (408A, 408B) from about 0.5 inches (") to about 6.0" from one or more surfaces of the component 410 or other components positioned in the system. In other examples, the support structure 420 can be configured to position the plurality of ultrasonic transducers of the first or second ultrasonic devices (408A, 408B) from about 1.0" to about 5.0" from one or more (inside or outside, depending upon the configuration of ultrasonic devices used) surfaces of the component 410. In other examples, the support structure 420 can be configured to position the plurality of ultrasonic transducers of the first or second ultrasonic devices (408A, 408B) from about 2.0" to about 3.0" from one or more surfaces of the component 410. While the relative distances of the transducers (e.g., 116 in FIGS. 1A and 1B) to the component 410 are discussed in FIG. 4 with respect to the ultrasonic system 400 of FIG. 4, the relative distances of the transducers to the components discussed in FIGS. 2 and 3 above may be similar to those discussed in FIG. 4.

The ultrasonic system 400 can further include a waste vessel 418, a fluid filtering system 414, a fluid pumping system 412, and a power supply 416. The power supply 416 may be configured to supply power to one or more of the ultrasonic devices (410A, 410B), the plurality of nozzles 424, the fluid vessel 428, the fluid filtering system 414, or the waste vessel 418. In other examples of the ultrasonic system 400, two or more power supplies similar to the power supply 416 may be used to control the various aspects of the ultrasonic system 400. The fluid vessel 428 discussed above may be configured to supply fluid to the component 410, such that the fluid flows through the component 410 either from the first end 410A to the second end 410B or from the second end 410B to the first end 410A. A plurality of logic stored in a non-transitory computer-readable medium can be in wired or wireless communication with elements of the ultrasonic system 400 and may be powered by the power supply 416. The plurality of logic can be stored in a non-transitory computer-readable medium such as indicated by element 426, and can control, for example, a speed and direction of fluid flow from the fluid vessel 428 or from the liquid 404 in the tank 402. In one example, the liquid 404 in the tank 402 and/or the fluid in the fluid vessel 428 can be heated to a temperature from about room temperature to about 80° C. The waste vessel 418 may be coupled to the tank 402, the fluid pumping system 412 (which may include a plurality of pumps) may be configured The plurality of logic can be in the form of one or more cleaning programs that control factors including: the fluid flow volume from the fluid vessel 428, a pressure of each of the plurality of nozzles 424 (which may differ among and between the nozzles), an angle of each of the plurality of nozzles 424, which nozzles of the plurality of nozzles 424 are in use, a time for fluid flow from the liquid 404 within the tank 402 to occur prior to filtering the liquid 404 via the fluid filtering system 414, a time for fluid flow from the fluid vessel 428 to occur prior to filtering the liquid 404 via the fluid filtering system, a frequency range for the one or more of the plurality of transducers of the first ultrasonic device 408A, a frequency range for the one or more of the plurality of transducers of the second ultrasonic device 408B, a temperature range, ramp up, and ramp down for the one or more of the plurality of heaters of the first ultrasonic device 408A and/or the second ultrasonic device 408B, as well as other parameters and combinations of parameters.

The fluid filtering system 414 may be configured to filter the contaminants removed from the component 410, deposit the contaminants in the waste vessel 418, and return the filtered liquid to the tank 402 or the fluid vessel 428. The recycled fluid can be used to continue to clean the component 410, or may be used in subsequent cleaning processes to clean other components (not shown here).

Example Components Cleaned Via Ultrasonic Systems

Figure 5:
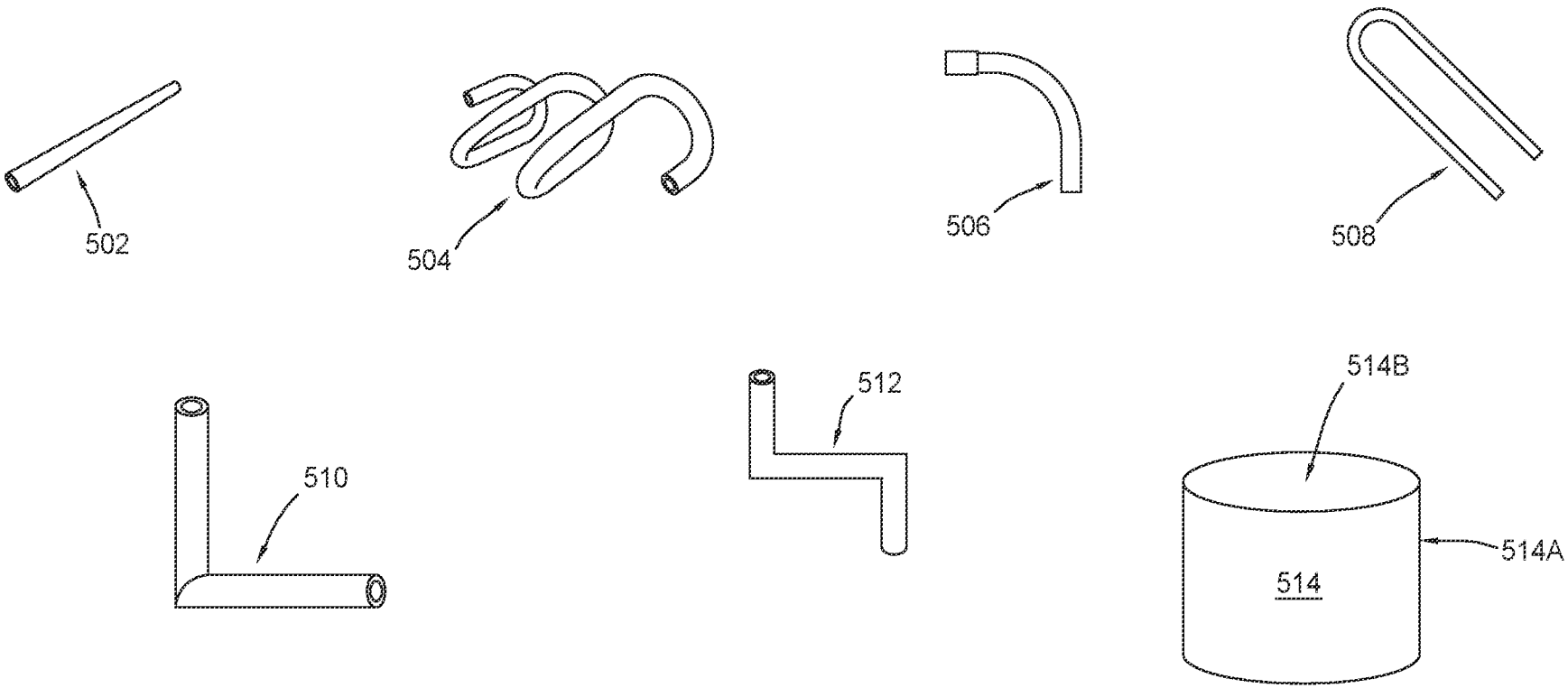
FIG. 5 (PRIOR ART)
FIG. 5 depicts example components that may be cleaned using the systems discussed herein according to aspects of the present disclosure.

FIG. 5 depicts example components that may be removably coupled to and, in some examples, cleaned using the ultrasonic systems discussed herein. For example, a straight component 502 of varying lengths and diameters may be cleaned, as well as a coiled component 504. In other examples, a curved component 506 may be cleaned, as well as a U-shaped component 508 having both curved and straight elements. In addition to components having smooth transitional external geometries, which may have smooth transitional internal geometries, components having sharp transitional geometries, both internal and external, may also be cleaned using the ultrasonic systems discussed herein. For example, L-shaped components 510 or components including two or more L-shaped bends 512. In some aspects, a vessel component 514, that may be referred to herein as a "processing vessel," may be coupled to the ultrasonic systems discussed herein as well. The vessel component 514 may be a processing vessel, configured to retain a mixture of elements and/or to deliver that mixture to a component or other vessel as part of a fabrication or cleaning process. In this example, the ultrasonic systems are configured as mixing systems, such that one or more ultrasonic devices (100A, 100B) may be removably coupled to an outside surface 514A of the vessel component 514 and/or positioned in a volume 514B of the vessel component 514. In this example, the ultrasonic cleaning may be used to form a homogenous mixture from one or more constituents disposed in the volume 518B of the vessel component 514.

The example components in FIG. 5 are illustrative of components that may be cleaned using the ultrasonic systems discussed herein, which are configured to remove contaminants from crevices, cracks, holes, pores, and features of varying sizes as discussed herein without damaging the component or coatings or features formed on or inside of the component. While the components shown in FIG. 5 each include an inside passage, in other examples of components cleaned by the ultrasonic systems including ultrasonic devices discussed herein, the components may not have inside passages, but may have other features such as pockets, angles, or other features that make ultrasonic cleaning desirable.

Example Method of Use of Ultrasonic Systems

Figure 6:
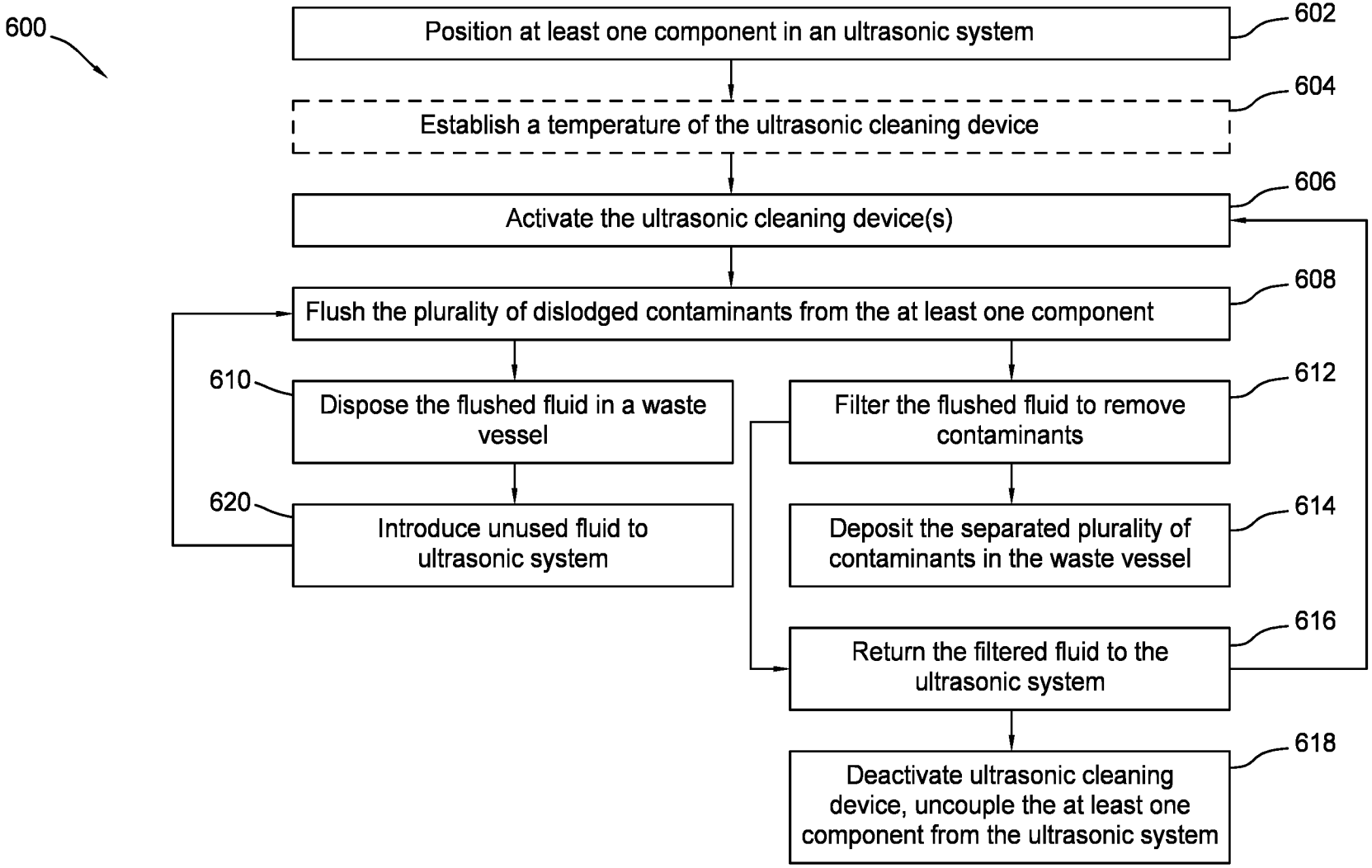
FIG. 6 depicts a flow chart for a method of cleaning one or more components using the ultrasonic devices according to aspects of the present disclosure.

FIG. 6 depicts a flow chart for a method 600 of cleaning one or more components using the ultrasonic devices according to aspects of the present disclosure. The method 600 may be performed using any combination of the ultrasonic devices and cleaning or mixing systems discussed herein. The method 600 includes the execution of one or more cleaning programs, which may include any combination of the operations discussed below.

At operation 602 of the method 600, at least one component is positioned in an ultrasonic system (602—Position at least one component in an ultrasonic system). The positioning of the at least one component at operation 602 may include positioning one or more ultrasonic devices inside of an inside passage of the component. In other examples, which can be combined with other examples herein, the positioning of the at least one component at operation 602 may include positioning one or more ultrasonic devices around an outside surface the at least one component. In other examples, the positioning of the at least one component at operation 602 may additionally or alternatively include removably coupling the at least one component to a support structure of the ultrasonic system. Optionally, at operation 604, a temperature of the ultrasonic device(s) used in the method 600 may be established (604—Establish a temperature of the ultrasonic device). In one example, the ultrasonic device does not include heating elements or includes heating elements that may not be used in the method 600. In other examples, the ultrasonic heating device includes heating elements that are activated at operation 604. In still other examples, operation 604 may include maintaining a consistent temperature during the method 600 or adjusting the temperature of the heating elements dynamically during the duration of the method 600. In one example, the temperature established at operation 604 may vary from room temperature (about 20° C. to about 23° C.) to about 80° C. In another example, the temperature established at operation 604 may be from about 30° C. to about 70° C. In another example, the temperature established at operation 604 may be from about 35° C. to about 60° C.

The method 600 further includes operation 606, where the ultrasonic device(s) is activated by applying, via a power supply, a current to the plurality of ultrasonic transducers for a predetermined period of time to dislodge a plurality of contaminants from the at least one component (606—Activate the ultrasonic device(s)). The predetermined period of time may be from about 1 minutes to about 2 hours. In another example, the predetermined period of time may be from about 30 minutes to 90 minutes. In yet another example, the predetermined period of time may be from about 45 minutes to 60 minutes. In one example, the current applied at operation 606 can be from about 1.0 amperes (A) to about 25.0 A. In another example, the current applied at operation 606 may be from about 3 A to about 20 A. In yet another example, the current applied at operation 606 can be from about 5 A to about 15 A Applying the current to the plurality of ultrasonic transducers (at operation 606), which can be configured to operate at a frequency from about 20 kilo-hertz (KHz) to about 100 KHz, causes a plurality of contaminants to be dislodged from the at least one component. In other examples, the plurality of ultrasonic transducers can be configured to operate at a frequency from about 20 kilo-hertz (KHz) to about 80 KHz. In still other examples, the plurality of ultrasonic transducers can be configured to operate at a frequency from about 30 kilo-hertz (KHz) to about 70 KHz.

The current applied to the plurality of ultrasonic transducers can be constant, varied, pulsed, or combinations thereof. Each pulse of the ultrasonic device may include configuring the ultrasonic device in a first state and a second state. The pulses discussed herein may include a first state where the ultrasonic device is active (powered on) and a second state where the ultrasonic device is not active (powered off). In another example, the first state of a pulsed power source may include activating the ultrasonic device to apply a first current and the second state may include activating the ultrasonic device to apply a second current, where the second current is less than the first current and the ultrasonic device is not deactivated in between the first state and the second state, nor in between pulses. In examples of the method 600 where the power is pulsed at operation 606, there may be from 2-100 pulses, where each pulse is from about 1 second to about 20 minutes and has a first state lasting from about 0.5 seconds to about 5 seconds. In another example, each pulse has a first state lasting from about 1 second to about 30 seconds. In yet another example, has a first state lasting from about 5 seconds to about 2 minutes.

At operation 608, the plurality of contaminants dislodged from the at least one component can be flushed from the ultrasonic system (608—Flush the plurality of dislodged contaminants from the at least one component). In some examples, the flushing at operation 608 may include flushing fluid from one or more inside passages of the at least one component. In other examples, which may be combined with other examples herein, the flushing at operation 608 may include flushing fluid from a tank, for example, the tank 402 as shown in FIG. 4. The fluid may be flushed using various configurations of one or more pumping systems that may be coupled to at least one of a tank or a component.

As discussed herein, "flushing" fluid may mean removing fluid and disposing of the fluid, or removing, filtering, and recycling the fluid. In one example, at operation 610, subsequent to flushing the fluid at operation 608, the flushed fluid is disposed of in one or more waste vessels (610—

Dispose the flushed fluid in a waste vessel). The waste vessel may be emptied and disposed of, or have its content treated prior to disposal, depending upon the type of fluid used and the locale in which disposal occurs.

In other examples of the method 600, subsequent to operation 608, the flushed fluid may be filtered at operation 612 to remove the contaminants from the fluid (612—Filter the flushed fluid to remove contaminants). The filtering may occur in a filtering system that is a part of the waste vessel, or in a separate filtering system coupled to the waste vessel such that the filtered plurality of contaminants is deposited in the waste vessel at operation 614 (Deposit the separated plurality of contaminants in the waste vessel). Further subsequent to operation 612, the filtered fluid may be returned to the ultrasonic system at operation 616 (616—Return the filtered fluid to the ultrasonic system). In one example, the fluid filtered at operation 612 may be returned to the ultrasonic system at operation 616 by depositing it in the tank (such as the tank 402 in FIG. 4). In another example, which can be combined with other examples herein, the fluid filtered at operation 612 may be returned to the ultrasonic system at operation 616 by supplying the filtered fluid directly to one or more inside passages of the at least one component. In still another example, which can be combined with other examples herein, the fluid filtered at operation 612 may be returned to the ultrasonic system at operation 616 by supplying the filtered fluid to a fluid vessel which is configured to supply the filtered fluid (alone or in combination with new, unused fluid) to one or more inside passages of the at least one component. The filtering at operation 612 may occur during the method 600 such that the fluid used at operation 608 to flush contaminants is recycled in a plurality of iterations while cleaning the at least one component positioned in the ultrasonic system at operation 602. In other examples, the filtering at operation 612 may occur during the method 600 such that the fluid used at operation 608 to flush contaminants is recycled and used in subsequent cleaning cycles to clean different components.

Depending upon the example, activation of the ultrasonic device(s) at operation 606 may occur, for example, from less than one minute to upwards of four hours. During operation 606, as discussed above, the fluid may be flushed and filtered iteratively at operations 608, 612, 614, and 616. In other examples, during operation 606, the fluid may be flushed at operation 608, disposed of at operation 610, and new, unused fluid may be introduced into the ultrasonic system (either in the tank, the inside passage(s), or both) at operation 620 in one or more iterations to continue to flush (operation 608) the contaminants dislodged by the activation of the ultrasonic devices at operation 606.

Subsequent to completing one or more cleaning programs to remove the contaminants from the at least one component, at operation 618, the ultrasonic device(s) activated at operation 606 are deactivated. Further at operation 618, the one or more components positioned in the ultrasonic system at operation 602 may be uncoupled from the ultrasonic system so that new, different components may be cleaned in the ultrasonic system.

The ultrasonic systems including ultrasonic devices discussed herein can be configured to clean inside passages and/or outside surfaces of one or more components, removing contaminants from smooth or textured surfaces, or other areas of components where it may be challenging to remove contaminants. In other examples, the ultrasonic systems discussed herein may be positioned around and/or inside of processing vessels in order to perform processing operations such as the formation of homogenous solutions and/or colloidal solutions that may include various sizes and types of particles, as discussed in FIG. 7 below.

Figure 7:
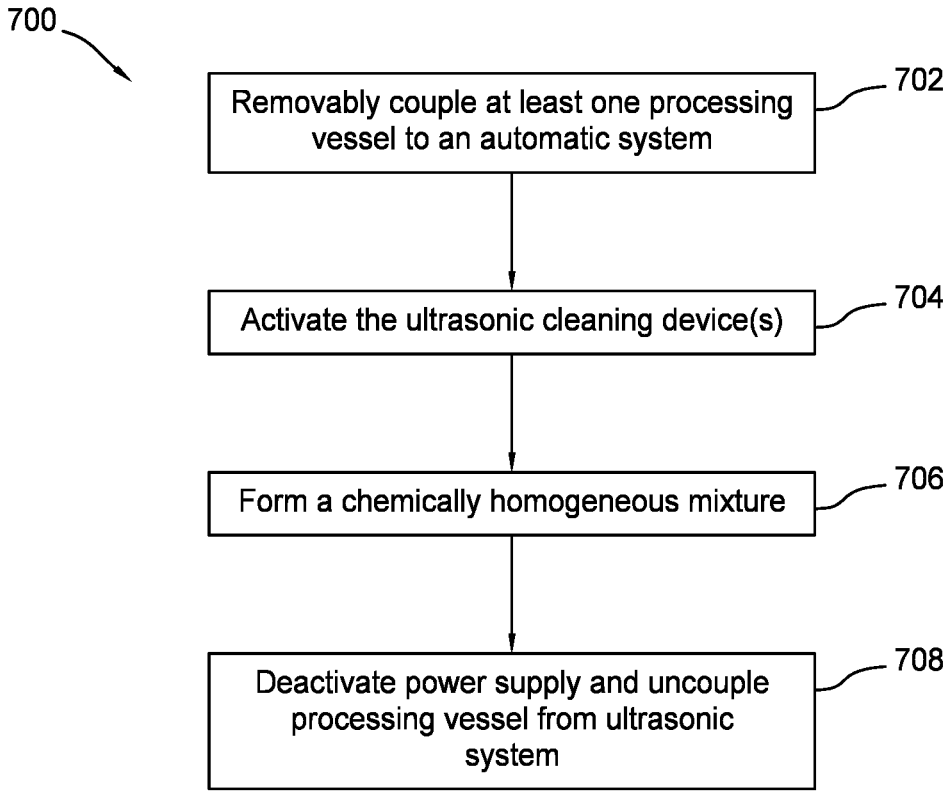
FIG. 7 depicts a method of forming a chemically homogenous mixture according to aspects of the present disclosure.

FIG. 7 depicts a method 700 of forming a chemically homogenous mixture according to aspects of the present disclosure. As discussed herein, a "chemically homogenous mixture" is a combination of two or more liquid, solid, or gas constituents having a target chemical composition, which may or may not include a target weight or volume percentage of particles of varying sizes, as discussed in detail below. The programs executed in the method of FIG. 7 may be referred to as "mixing programs" and may include factors such as an intensity and/or time for a current applied to an ultrasonic device(s), pulsing parameters (time, duration) for the current, a temperature of the ultrasonic device, or other factors or combinations of factors that may be associated with one or more processing operations such as mixing.

At operation 702, a processing vessel is removably coupled to an ultrasonic system (702—Removably couple at least one processing vessel to an ultrasonic system). Operation 702 may include removably coupling an ultrasonic device similar to the first ultrasonic device 100A discussed in FIG. 1A to the processing vessel, which may be similar to the vessel component 514 in FIG. 5. In other examples, the processing vessel may take other shapes and forms, or may include a plurality of processing vessels disposed in a fixture, such that multiple homogenous solutions are formed simultaneously. In other examples, operation 702 may additionally or alternatively include removably coupling one or more ultrasonic devices similar to the second ultrasonic device 100B discussed in FIG. 1B to the processing vessel(s). In some examples, two or more of the ultrasonic devices 100A or 100B may be removably coupled to the processing vessel by being positioned relative to or coupled directly to one or more of an outside surface or an inside surface of the processing vessel(s). In other examples, a combination of the first ultrasonic device 100A and the second ultrasonic device 100B may be removably coupled to the processing vessel by being positioned relative to or coupled directly to one or more of an outside surface or an inside surface of the processing vessel(s). The processing vessels discussed herein may include smooth inside surfaces or rough inside surfaces, such that the inside surface may or may not contribute to the mixing processes discussed herein.

The method 700 further includes operation 704, where the ultrasonic device(s) is activated by applying, via a power supply, a current to the plurality of ultrasonic transducers to dislodge a plurality of contaminants from the at least one component (704—Activate the ultrasonic device(s)). In one example, the current applied at operation 704 can be from about 1.0 amperes (A) to about 25.0 A. In another example, the current applied at operation 704 may be from about 3 A to about 20 A. In yet another example, the current applied at operation 704 can be from about 5 A to about 15 A Applying the current to the plurality of ultrasonic transducers (at operation 704), which can be configured to operate at a frequency from about 20 kilo-hertz (KHz) to about 100 KHz, causes two or more constituents disposed in the processing vessel to form a homogenous mixture. The two or more constituents may include two liquids, two solids, a liquid and a solid, or other combinations of constituents. In other examples, one or more gaseous constituents may be disposed in the processing vessel during operation 706 discussed below, to be included in the homogenous mixture. In this example, a vessel including the gaseous constituent may be coupled to the ultrasonic system such that an outlet of the vessel having the gaseous constituent is positioned to deliver the gas to the processing vessel.

In some examples, the one or more solid components disposed in the processing vessel can include nano-, micro-, or macro-sized particles of varying geometries A nano-sized particle includes a particle having a maximum dimension of about 100 nm, and a macro-sized particle is a particle having a minimum dimension that can be seen without magnification, including the magnification of prescription eyewear. Micro-sized particle are particles having a minimum dimension greater than 101 nm but which may not be visible without magnification (e.g., a lens other than a prescription eyewear lens would be used to view the micro-sized particles). In other examples, the plurality of ultrasonic transducers can be configured to operate at a frequency from about 20 kilo-hertz (KHz) to about 80 KHz. In still other examples, the plurality of ultrasonic transducers can be configured to operate at a frequency from about 30 kilo-hertz (KHz) to about 70 KHz.

The current applied to the plurality of ultrasonic transducers can be constant, varied, pulsed, or combinations thereof. Each pulse of the ultrasonic device may include configuring the ultrasonic device in a first state and a second state. The pulses discussed herein may include a first state where the ultrasonic device is active (powered on) and a second state where the ultrasonic device is not active (powered off). In another example, the first state of a pulsed power source may include activating the ultrasonic device to apply a first current and the second state may include activating the ultrasonic device to apply a second current, where the second current is less than the first current and the ultrasonic device is not deactivated in between the first state and the second state, nor in between pulses. In examples of the method 700 where the power is pulsed at operation 704, there may be from 2-100 pulses, where each pulse is from about 1 second to about 20 minutes and has a first state lasting from about 0.5 seconds to about 5 seconds. In another example, each pulse has a first state lasting from about 1 second to about 30 seconds. In yet another example, has a first state lasting from about 5 seconds to about 2 minutes.

At operation 706, in response to the activation of the ultrasonic device(s) at operation 704, chemically homogenous mixture is formed in the one or more processing vessels (706—Form a chemically homogenous mixture). The mixture formed at operation 706 may be a solution or a colloidal mixture, as any solids that may be mixed at operation 704 may dissolve or may remain as particulates suspended in the mixture. At operation 708, subsequent to forming the homogenous mixture at operation 706, the ultrasonic device(s) is deactivated and the processing vessels are uncoupled from the ultrasonic system (708—Deactivate ultrasonic device(s) and uncouple processing vessel from ultrasonic system). The homogeneous mixtures formed in the one or more processing vessels may (a) be removed from the processing vessels and used for various operations and/or (b) have additional components added to the processing vessel, and repeat operations 702-706 to form different chemically homogenous mixtures.

Using the systems and methods discussed herein, ultrasonic devices are used for cleaning and mixing operations. The cleaning operations can use less energy, less solvent, no solvent, or otherwise be environmentally friendly as well as efficient for cleaning and mixing operations. A variety of chemically homogenous mixtures may be formed using these systems, and a wide range of components of varying materials and having varying geometries, including intricate, complicated geometries, can have contaminants removed from both inside passages and outside surfaces, including when porous coatings or other features that may tend to collect contaminants are present.

In the current disclosure, reference is made to various aspects. However, it should be understood that the present disclosure is not limited to specific described aspects. Instead, any combination of the above features and elements, whether related to different aspects or not, is contemplated to implement and practice the teachings provided herein. Additionally, when elements of the aspects are described in the form of "at least one of A and B," it will be understood that aspects including element A exclusively, including element B exclusively, and including element A and B are each contemplated. Furthermore, although some aspects may achieve advantages over other possible solutions and/or over the prior art, whether or not a particular advantage is achieved by a given aspect is not limiting of the present disclosure. Thus, the aspects, features, aspects and advantages disclosed herein are merely illustrative and are not considered elements or limitations of the appended claims except where explicitly recited in a claim(s). Likewise, reference to "the invention" shall not be construed as a generalization of any inventive subject matter disclosed herein and shall not be considered to be an element or limitation of the appended claims except where explicitly recited in a claim(s).

As will be appreciated by one skilled in the art, aspects described herein may be embodied as a system, method or computer program product. Accordingly, aspects may take the form of an entirely hardware aspect, an entirely software aspect (including firmware, resident software, micro-code, etc.) or an aspect combining software and hardware aspects that may all generally be referred to herein as a "circuit," "module" or "system." Furthermore, aspects described herein may take the form of a computer program product embodied in one or more computer readable storage medium(s) having computer readable program code embodied thereon.

Program code embodied on a computer readable storage medium may be transmitted using any appropriate medium, including but not limited to wireless, wireline, optical fiber cable, RF, etc., or any suitable combination of the foregoing.

Computer program code for carrying out operations for aspects of the present disclosure may be written in any combination of one or more programming languages, including an object oriented programming language such as Java, Smalltalk, C++ or the like and conventional procedural programming languages, such as the "C" programming language or similar programming languages. The program code may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider).

Aspects of the present disclosure are described herein with reference to flowchart illustrations and/or block diagrams of methods, apparatuses (systems), and computer program products according to aspects of the present disclosure. It will be understood that each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the block(s) of the flowchart illustrations and/or block diagrams.

These computer program instructions may also be stored in a computer readable medium that can direct a computer, other programmable data processing apparatus, or other device to function in a particular manner, such that the instructions stored in the computer readable medium produce an article of manufacture including instructions which implement the function/act specified in the block(s) of the flowchart illustrations and/or block diagrams.

The computer program instructions may also be loaded onto a computer, other programmable data processing apparatus, or other device to cause a series of operational steps to be performed on the computer, other programmable apparatus or other device to produce a computer implemented process such that the instructions which execute on the computer, other programmable data processing apparatus, or other device provide processes for implementing the functions/acts specified in the block(s) of the flowchart illustrations and/or block diagrams.

The flowchart illustrations and block diagrams in the Figures illustrate the architecture, functionality, and operation of possible implementations of systems, methods, and computer program products according to various aspects of the present disclosure. In this regard, each block in the flowchart illustrations or block diagrams may represent a module, segment, or portion of code, which comprises one or more executable instructions for implementing the specified logical function(s). It should also be noted that, in some alternative implementations, the functions noted in the block may occur out of the order noted in the Figures. For example, two blocks shown in succession may, in fact, be executed substantially concurrently, or the blocks may sometimes be executed in the reverse order or out of order, depending upon the functionality involved. It will also be noted that each block of the block diagrams and/or flowchart illustrations, and combinations of blocks in the block diagrams and/or flowchart illustrations, can be implemented by special purpose hardware-based systems that perform the specified functions or acts, or combinations of special purpose hardware and computer instructions.

While the foregoing is directed to aspects of the present disclosure, other and further aspects of the disclosure may be devised without departing from the basic scope thereof, and the scope thereof is determined by the claims that follow.

What is claimed is:

1. A method of using an ultrasonic system, comprising:

positioning and removably coupling at least one component in an ultrasonic system, the ultrasonic system comprising:

an ultrasonic device, comprising a plurality of ultrasonic transducers coupled to a flexible body;

a power supply coupled to the ultrasonic device;

a fluid vessel configured to supply fluid to the at least one component; and a waste vessel configured to collect fluid supplied to the ultrasonic device from the fluid vessel;

establishing a temperature of the ultrasonic device from about room temperature to about 80° C. via at least one heating element embedded in the flexible body applying, via the power supply, a current to a plurality of ultrasonic transducers to dislodge a plurality of contaminants from the at least one component; and flushing, via fluid from the fluid vessel, the plurality of contaminants dislodged from the at least one component.

2. The method of claim 1, further comprising removing, via the waste vessel, the plurality of contaminants and the fluid used to dislodge the plurality of contaminants.

3. The method of claim 1, further comprising:

filtering, via a filtering system coupled to the ultrasonic system, the fluid used to dislodge the plurality of contaminants to separate the plurality of contaminants from the fluid;

depositing, in the waste vessel, the plurality of contaminants separated during the filtering; and returning filtered fluid to the ultrasonic system.

4. The method of claim 1, wherein removably coupling the at least one component to the ultrasonic system comprises positioning an ultrasonic device inside of the at least one component.

5. The method of claim 1, wherein removably coupling the at least one component to the ultrasonic system comprises removably coupling an ultrasonic device to an outside surface of the at least one component.

6. The method of claim 1, wherein removably coupling the at least one component to the ultrasonic system comprises positioning the ultrasonic device inside of the at least one component and removably coupling the ultrasonic device to an outside surface of the at least one component.

7. The method of claim 1, wherein the power supply is configured to supply a current of 1 amperes (A) to about 25 A to the plurality of ultrasonic transducers.

8. The method of claim 1, wherein applying the current comprises pulsing the power supply for a plurality of pulses.

9. The method of claim 8, wherein each pulse of the plurality of pulses is from about 1 second to about 20 minutes.

10. The method of claim 1, wherein the temperature of the ultrasonic device is about 30° C. to about 70° C.

11. The method of claim 10, wherein the temperature of the ultrasonic device is about 35° C. to about 60° C.

12. The method of claim 7, wherein the power supply is configured to supply a current of 3 A to about 20 A to the plurality of ultrasonic transducers.

13. The method of claim 12, wherein the power supply is configured to supply a current of 5 A to about 15 A to the plurality of ultrasonic transducers.

14. The method of claim 1, wherein the plurality of ultrasonic transducers are configured to operate at a frequency of about 20 kilo-hertz (KHz) to about 100 KHz.

15. The method of claim 14, wherein the plurality of ultrasonic transducers are configured to operate at a frequency of about 20 KHz to about 80 KHz.

16. The method of claim 15, wherein the plurality of ultrasonic transducers are configured to operate at a frequency of about 30 KHz to about 70 KHz.

17. The method of claim 9, wherein the plurality of pulses comprise a first state and a second state, the ultrasonic device being active to apply a current in the first state, and the ultrasonic device applying a second current in the second state lower than the current in the first state.

18. The method of claim 17, wherein the plurality of pulses has a first state lasting from about 0.5 seconds to about 2 minutes.

19. The method of claim 18, wherein the plurality of pulses has a first state lasting from about 1 second to about 30 seconds.

20. The method of claim 19, wherein the plurality of pulses has a first state lasting from about 1 second to about 5 seconds.

21. The method of claim 3, further comprising:

deactivating the ultrasonic device(s), and uncoupling the at least one component positioned within the ultrasonic system.

22. The method of claim 1, further comprising adjusting the temperature of the ultrasonic device dynamically during operation.

23. The method of claim 1, wherein the ultrasonic device is activated by applying a current to the plurality of ultrasonic transducers for a predetermined period of time from about 1 minute to about 2 hours.

24. The method of claim 23, wherein the predetermined period of time is about 30 minutes to about 90 minutes.

25. The method of claim 24, wherein the predetermined period of time is about 45 minutes to 60 minutes.

* * * * *